US010028590B2

(12) United States Patent
Bonner et al.

(10) Patent No.: US 10,028,590 B2
(45) Date of Patent: Jul. 24, 2018

(54) COUCH COT COVER

(71) Applicant: American National Manufacturing, Inc., Corona, CA (US)

(72) Inventors: Joseph Charles Bonner, Irvine, CA (US); Chad Shane Miller, Corona, CA (US)

(73) Assignee: American National Manufacturing, Inc., Corona, CA (US)

( * ) Notice: Subject to any disclaimer, the term of this patent is extended or adjusted under 35 U.S.C. 154(b) by 40 days.

(21) Appl. No.: 14/548,063

(22) Filed: Nov. 19, 2014

(65) Prior Publication Data

US 2016/0135599 A1 May 19, 2016

(51) Int. Cl.
*A47C 19/20* (2006.01)
*A47C 7/62* (2006.01)

(52) U.S. Cl.
CPC ..... *A47C 19/202* (2013.01); *A47C 7/62* (2013.01)

(58) Field of Classification Search
CPC ..... A47C 17/14; A47C 17/22; A47C 17/23; A47C 17/82; A47C 19/202
See application file for complete search history.

(56) References Cited

U.S. PATENT DOCUMENTS

| | | | | |
|---|---|---|---|---|
| 1,907,698 | A * | 5/1933 | Albach | B65D 25/106 206/321 |
| 5,484,092 | A * | 1/1996 | Cheney | B60R 7/14 206/317 |
| 6,434,766 | B1 * | 8/2002 | Beddawi | A47B 83/00 5/12.1 |
| 7,240,381 | B1 * | 7/2007 | Hawse | A47C 17/161 5/18.1 |
| 7,997,216 | B2 * | 8/2011 | Thornbury | A47B 37/04 108/157.1 |
| 8,220,085 | B2 * | 7/2012 | Claffy | A47C 19/202 5/110 |
| 2009/0193765 | A1 * | 8/2009 | Lantz | B65D 5/0005 53/473 |
| 2011/0011762 | A1 * | 1/2011 | Hurst | B65D 33/2591 206/326 |
| 2014/0144808 | A1 * | 5/2014 | Anderson | B65D 5/68 206/736 |

* cited by examiner

*Primary Examiner* — Philip F Gabler
(74) *Attorney, Agent, or Firm* — Spencer Fane LLP

(57) ABSTRACT

A cover assembly internally supported by a removable irregular object provides a seating apparatus. A top cover and a bottom cover are separated allowing access to the object within. A cushion assembly conforms to the irregular upper surface of the object forming a generally uniform top surface for the cover assembly. Foam structural supports in the corners of the cover assembly provide additional structural support and padding. A back support provides support for a person sitting on the cover assembly.

25 Claims, 10 Drawing Sheets

COUCH COT COVER

BACKGROUND

The present disclosed subject matter relates generally to body support apparatus, and more particularly to a seating assembly internally supported by a removable object.

Single use furniture, such as chairs, tables, and sleeping cots are stored when not in use. Such furniture is often designed to be stacked to take up less space when not in use. However, when stacked, such furniture provides no useful purpose.

SUMMARY

A couch cot cover includes a cover assembly internally supported by an irregular object, such as stacked sleeping cots, providing a seating assembly. The cover assembly includes a top cover assembly connected to a bottom cover assembly allowing access to the cots stored therein. The top cover assembly includes a cushion assembly that has a bottom surface configured to conform to the irregular upper surface of the stacked cots. The top cover assembly and bottom cover assembly include foam corner supports providing additional structural support to the cover assembly as well as padding to the corners.

An alternative embodiment cover assembly includes a back support portion received within an upper chamber of the top cover assembly.

DESCRIPTION OF THE DRAWINGS

The drawings constitute a part of this specification and include exemplary embodiments of the disclosed subject matter and illustrate various objects and features thereof.

DETAILED DESCRIPTION

Figure 1:
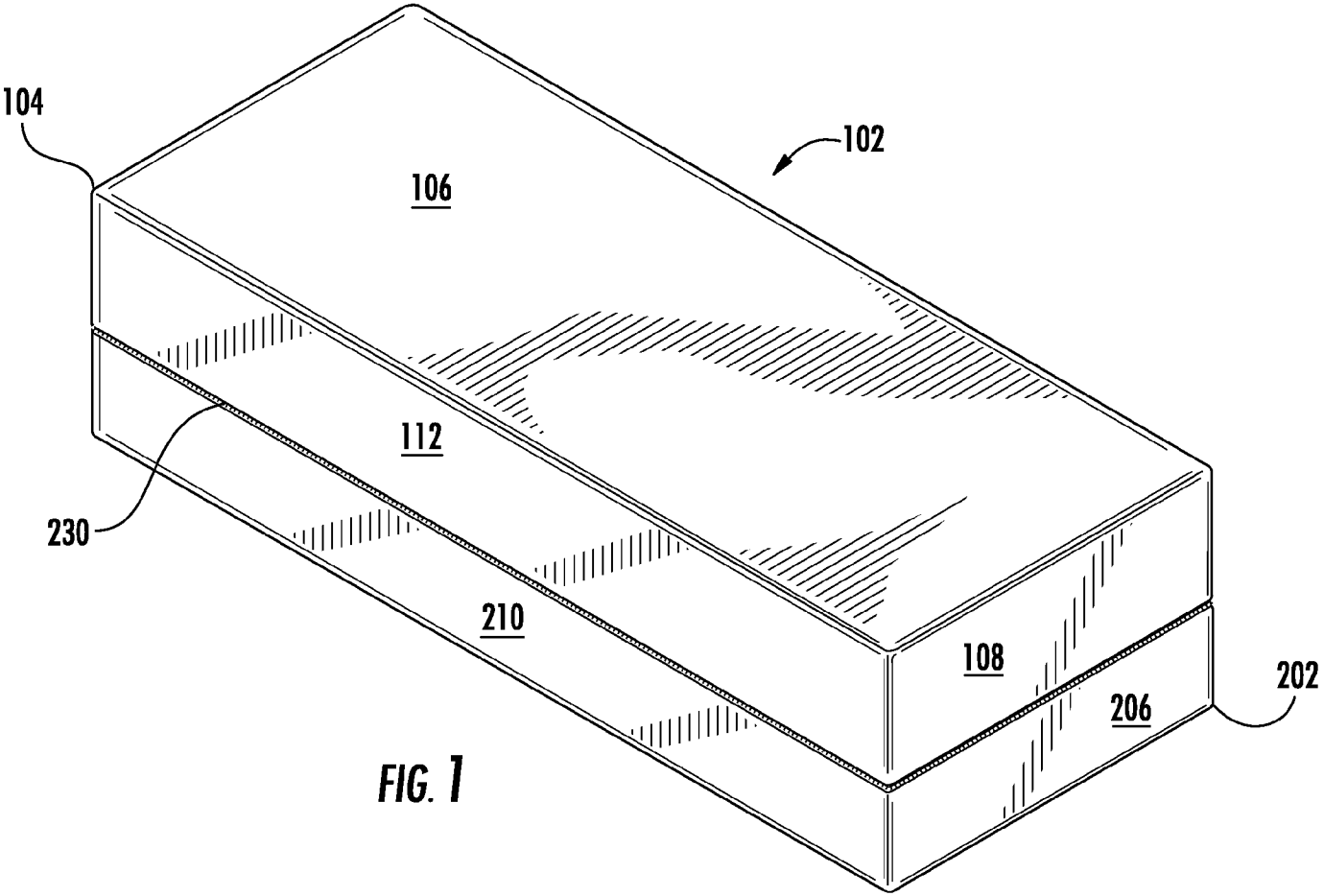
FIG. 1 is a perspective view from above of an internally supported seating assembly embodying principles of the disclosed subject matter.

As required, detailed aspects of the disclosed subject matter are disclosed herein; however, it is to be understood that the disclosed aspects are merely exemplary of the disclosed subject matter, which may be embodied in various forms. Therefore, specific structural and functional details disclosed herein are not to be interpreted as limiting, but merely as a basis for the claims and as a representative basis for teaching one skilled in the art how to variously employ the disclosed technology in virtually any appropriately detailed structure.

Certain terminology will be used in the following description for convenience in reference only and will not be limiting. For example, up, down, front, back, right, and left refer to the disclosed subject matter as orientated in the view being referred to. The words, inwardly and outwardly refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof, and words of similar meaning.

Referring to FIGS. 1-9, an embodiment of a seating assembly internally supported by a removable object is shown. In particular, a cover assembly 102 is shown. The assembly 102 is used to store an object 250 with an irregular upper surface where the object supports the assembly 102 when it is in use. The cover assembly 102 generally includes a top cover assembly 104 connected to a bottom cover assembly 202, wherein the interior of the top cover assembly 104 includes a cushion assembly 130 configured to conform to the irregular upper surface of the object 250.

Figure 2:
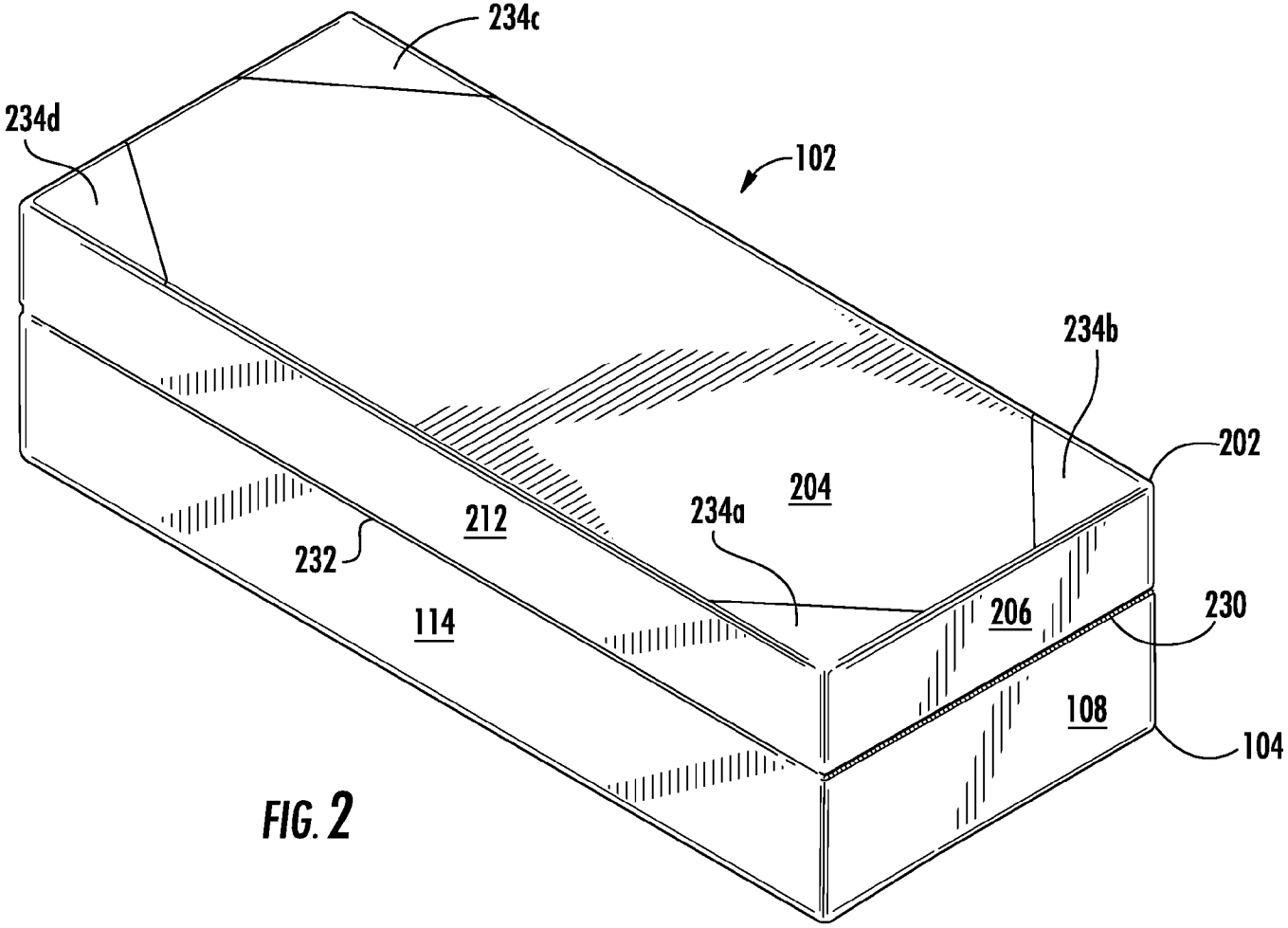
FIG. 2 is a perspective view from below of the seating assembly.

Referring to FIGS. 1-2, an embodiment of the cover assembly 102 is shown in a closed configuration whereby the top cover assembly 104 and bottom cover assembly 202 are joined at their left, front, and right sidewalls by a cooperating removable connector. In an embodiment, the cooperating removable connector is a hookless fastener such as a zipper 230. The top cover assembly 104 includes a first upper panel 106 with sidewalls depending therefrom. The sidewalls include a left panel 108 and opposite right panel 110, and a first front panel 112 and opposite first rear panel 114 forming a downwardly open rectangular enclosure forming four interior corners. The bottom cover assembly 202 includes a lower panel 204 with sidewalls extending upward therefrom. The sidewalls include a left panel 206 and opposite right panel 208, and a front panel 210 and opposite rear panel 212 forming an upwardly open rectangular enclosure forming four interior corners. First rear panel 114 and rear panel 212 are connected at a seam 232 allowing the top cover assembly 104 to be hingedly opened upward and away from the bottom cover assembly 202 for accessing the object therein. In an embodiment, a corner element 234*a, b, c*, and *d* at each corner extends between adjacent sidewalls providing additional wear resistance between the lower panel 204 and a support surface. In an embodiment, the corner elements 234*a, b, c*, and *d* are composed of a non-skid material.

Figure 3:
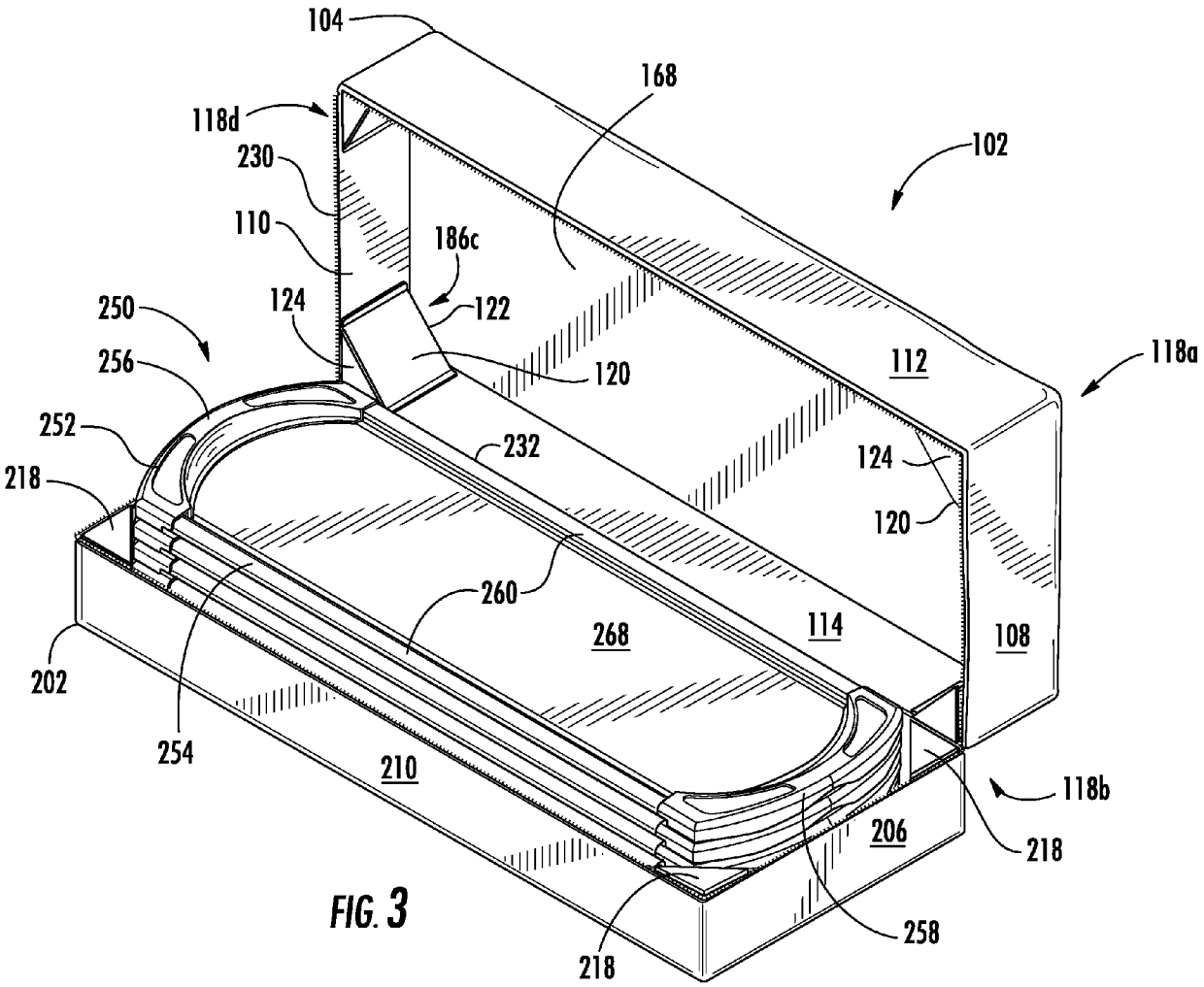
FIG. 3 is a perspective view of the cover assembly open with the top portion separated from the bottom portion exposing the cots contained therein.

Referring to FIG. 3, the cover assembly 102 is shown in an open configuration with the zipper 230 shown disengaged thereby allowing access to the object 250 therein. In an embodiment, the object 250 includes a number of stacked elements such as cots 252. The cots 252 include a generally rectangular frame 254 with a first end 256 and an opposite second end 258 forming crescent-shaped ends connected by opposing side rails 260. A resting surface 268 within the frame 254 is lower than the ends 256, 258, and side rails 260 forming a depression or negative relief. The four corners of the frame 254 include hollow legs or pedestals elevating the frame 254 above a surface, such as the floor when the cots 252 are used for resting. The pedestals are open at the top and closed at the bottom allowing one cot 252 to be nested one on top of the other. In an embodiment, the ends have a curved height contour with the middle of each end 256, 258 higher than the ends connected to the side rails 260. The structure of the cot 252 that extends above the level of the side rails 260 forms a positive relief.

Figure 4:
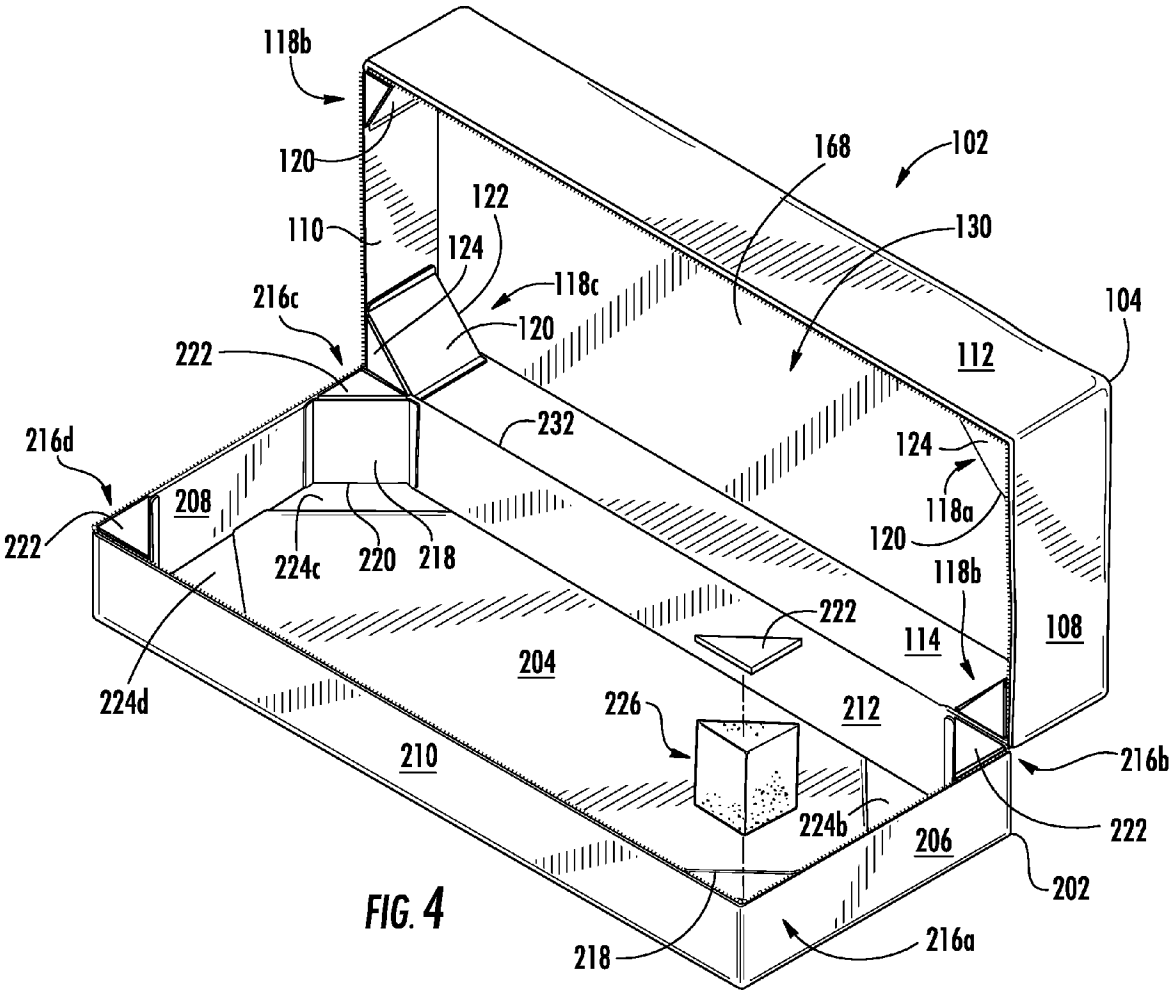
FIG. 4 is a perspective view of the cover assembly open with the cots removed.
Figure 5:
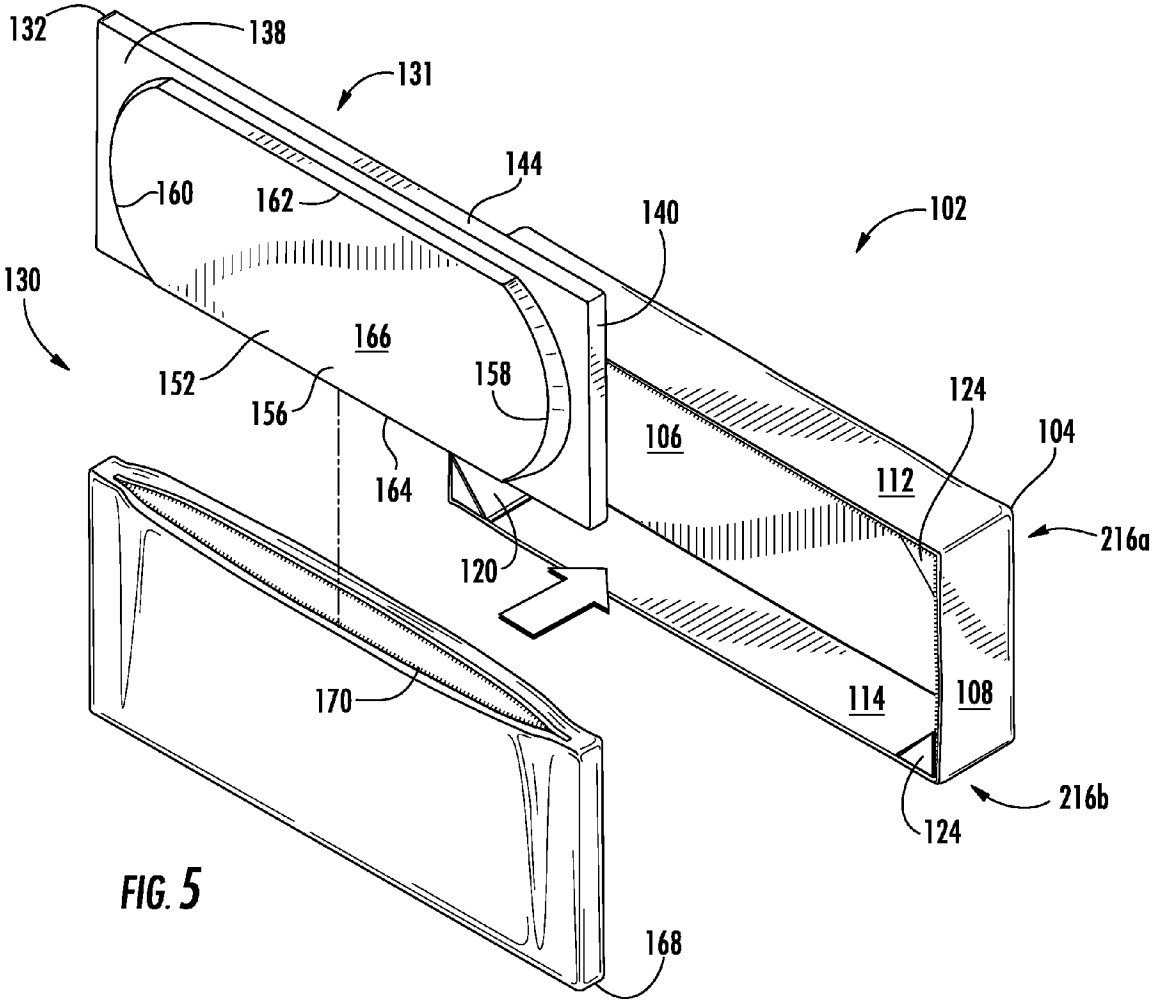
FIG. 5 is a view of the foam top portion insert removed from the sleeve.
Figure 6:
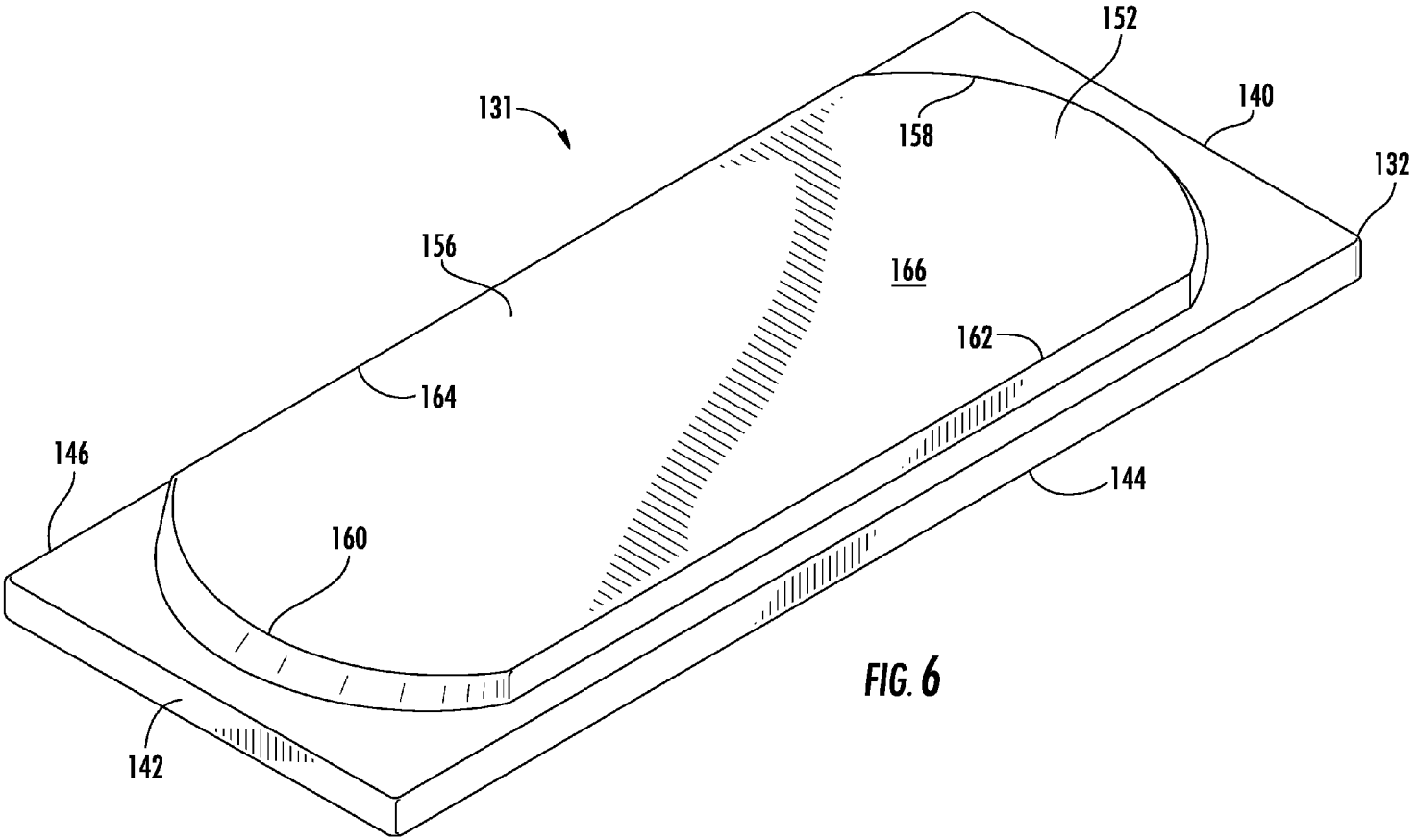
FIG. 6 is a perspective view from above of the foam top portion insert.

Referring to FIG. 4, the interior of the bottom cover assembly 202 includes lower corner pockets 216*a, b, c*, and *d* for retaining a corner support 226. The corner support 226 provides structural support for the cover assembly 102 when it is in the closed configuration, and provides a fill material between the object 250 and the cover assembly 102. In an embodiment, the corner support 226 is a triangular shaped column of resilient material, such as foam. The corner pocket 216 includes a corner cover 218 extending laterally between, and connected to, adjacent sidewalls, and extends vertically from an upper point adjacent the upper edge of the sidewalls, to a lower point adjacent the lower panel 204. An upper cap 222 connected to the upper point of the corner cover 218 and the adjacent sidewalls forming a downwardly open triangular pocket. A corner support 226 is inserted into each lower corner pocket 216*a, b, c*, and *d* from the bottom by a lower opening 220. In an embodiment, a corner element 224*a* (not shown), *b, c*, and *d* at each corner extends between adjacent sidewalls providing additional wear resistance between the object 250 and the lower panel 204 adjacent corner pockets 216*a, b, c*, and *d*.

The interior of the top cover assembly 104 includes upper corner pockets 118*a, b, c*, and *d* for retaining a corner support 220. The corner pocket 118 includes a corner cover 120 extending laterally between, and connected to, adjacent sidewalls, and extends vertically from a lower point adjacent the lower edge of the sidewalls, to an upper point adjacent the first upper panel 106. A lower cap 124 connected to the lower point of the corner cover 120 and the adjacent sidewalls forming an upwardly open triangular pocket. The corner support 126 is inserted into the upper corner pocket 118 from the top by an upper opening 122. Space is provided between the upper edge of the corner support 126 and the corner cover 120, and the bottom of the first upper panel 106, to accommodate a cushion assembly 130.

The cushion assembly 130 includes a deformable material, such as a pad assembly 131 enveloped by a sleeve 168. The sleeve 168 includes a zipper 170 along an edge for inserting the pad assembly 131. The pad assembly 131 includes an irregular bottom surface 166 that generally conforms to the irregular upper surface of the object 250 within the cover assembly 102, and a generally uniform top surface. The bottom surface 166 accommodates the irregular upper surface presented by the object 250 thereby allowing the cover assembly 102 to be used as a seating surface when the cover assembly 102 is in a closed configuration.

In an embodiment, the pad assembly 131 is formed from a monolithic piece of material. In another embodiment, the pad assembly 131 is formed from an upper portion or first pad 132, and a lower portion or second pad 152. The first and second pads 132, 152 cooperate to form the bottom surface 166. Referring to FIGS. 5-8, an embodiment of the first and second pads 132, 152 are shown where the second pad 152 is formed to conform to the negative relief of a cot 252, and the first pad 132 has a peripheral edge that extends beyond the edges of the second pad 152 and is formed to conform to the positive relief of the cot 252. The first pad 132 is generally rectangular and has a width extending between a left end 140 and a right end 142, a depth extending between a front end 144 and a back end 146, and a thickness extending between a top end and a bottom end 138. The second pad 152 is generally rectangular and has a width extending between a crescent shaped left end 158 and crescent shaped right end 160, a depth extending between a front end 162 and a back end 164, and a thickness extending between a top end 154 and a bottom end 156.

Figure 7B:
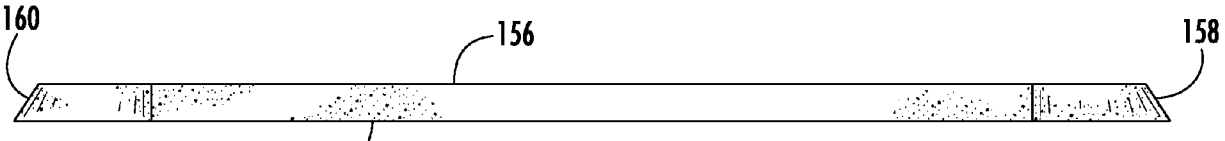
FIG. 7B is an elevation view of the foam top portion insert.
Figure 7A:
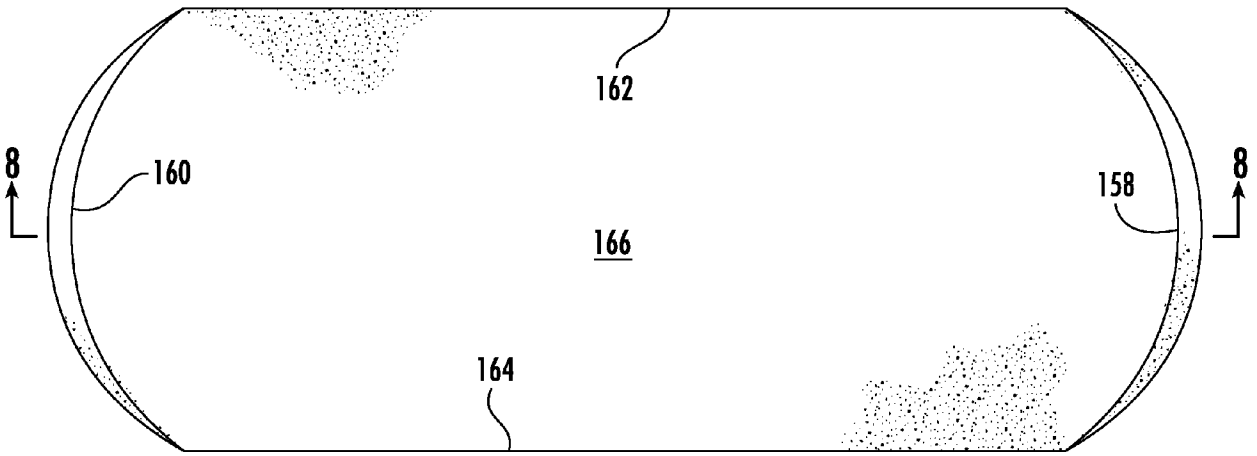
FIG. 7A is a plan view of the foam top portion insert.
Figure 8:
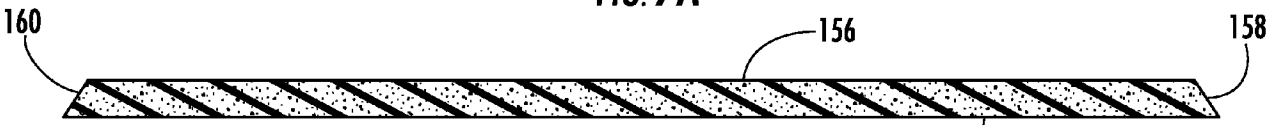
FIG. 8 is a cross-sectional view of the foam top portion insert.
Figure 9:
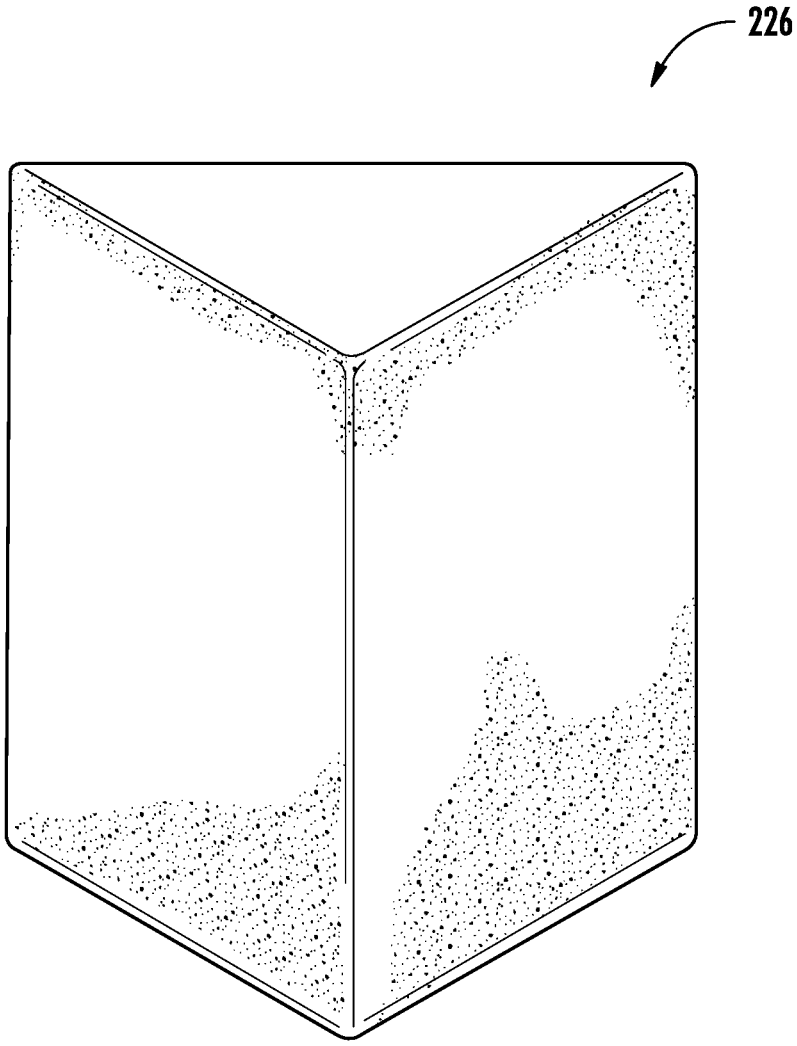
FIG. 9 is a perspective view of the foam corner insert.

Referring to FIGS. 7-8, the left and right ends 158 and 160 of the second pad 152 include a crescent shaped taper extending outward from the bottom end 156 to the top end 154, and from a broad middle portion to narrow end portions at the front and back ends 162, 164, allowing the pad assembly 131 to accommodate the transition between the negative relief and the positive relief.

The cushion assembly 130 is inserted into the interior of the top cover assembly 104 by orientating the top of the first pad 132 toward the first upper panel 106, and the bottom surface 166 downward toward the object 250. The upper corner pockets 118*a, b, c*, and *d*, and the corner supports 126 therein do not extend the entire height of the top cover assembly 104 sidewalls allowing room for the end corners of the cushion assembly 130 to be held in place by the corner supports 126.

Figure 10:
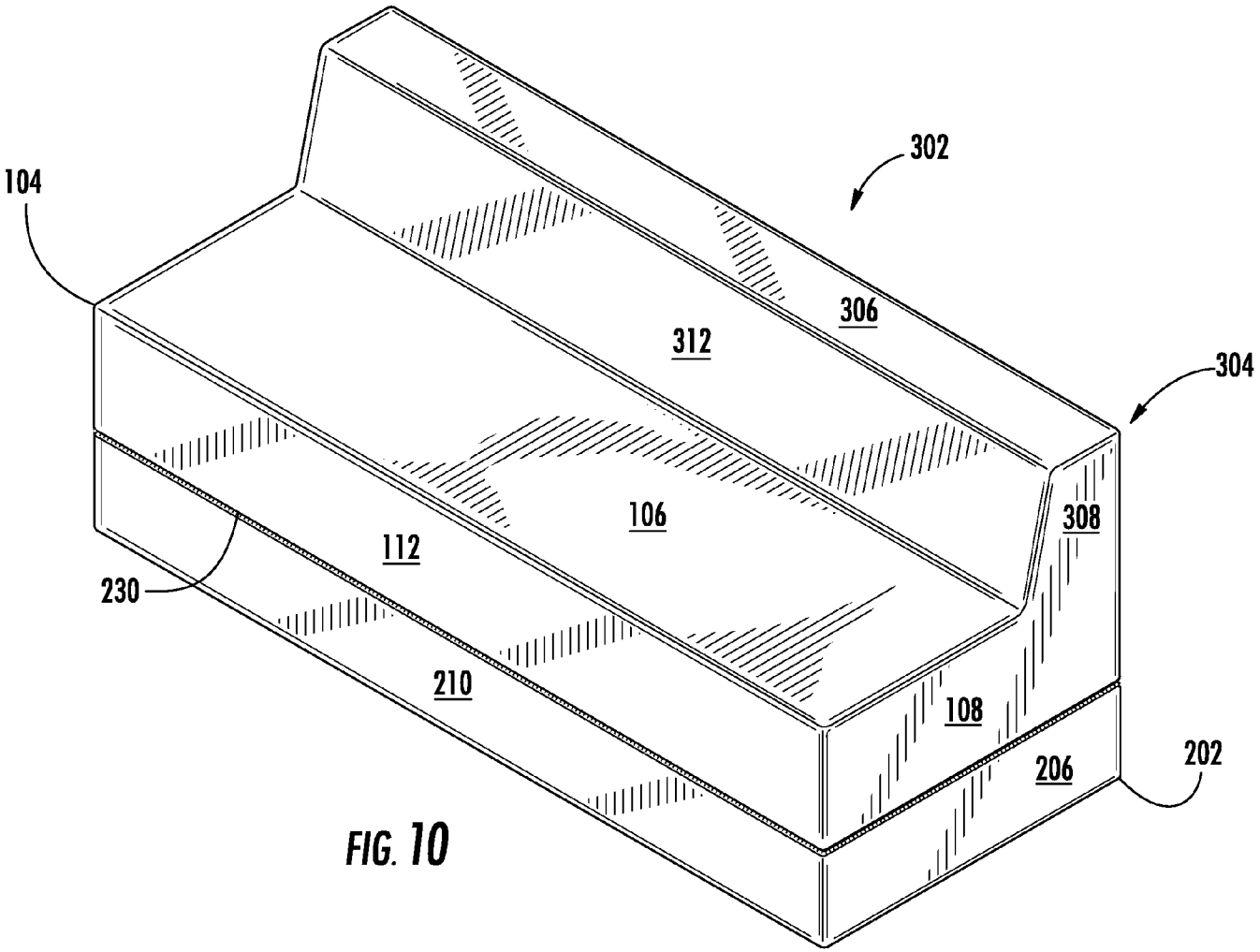
FIG. 10 is a perspective view from above of an alternative embodiment internally supported seating assembly embodying principles of the disclosed subject matter
Figure 11:
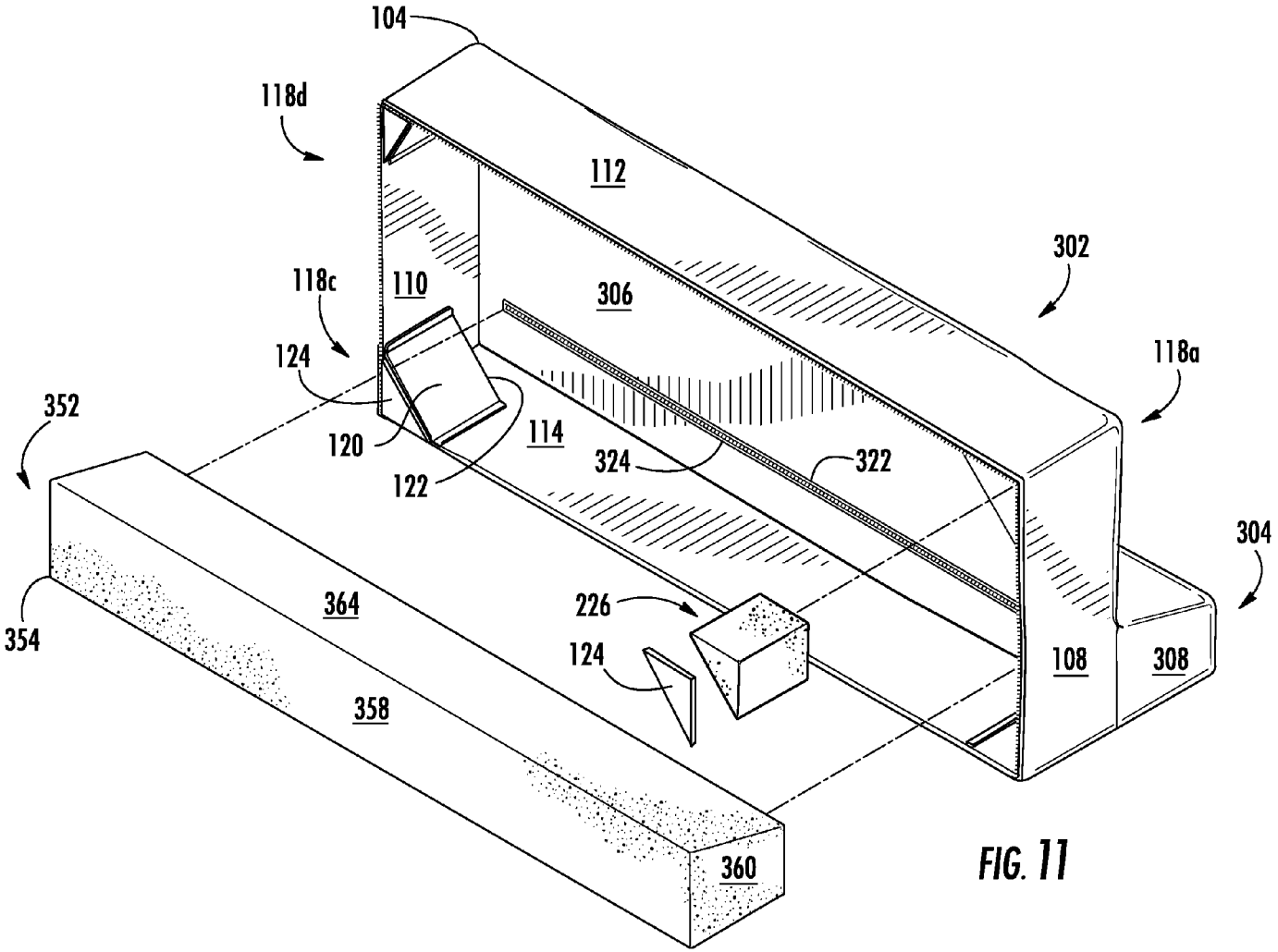
FIG. 11 is a perspective view from below of a wedge assembly and the top cover assembly.

Referring to FIGS. 10-11, an alternative embodiment cover assembly 302 is shown. The alternative embodiment cover assembly 302 generally includes the components of the cover assembly 102 with the addition of an upper chamber for receiving a wedge assembly 352 thereby defining a back support portion 304. The back support portion 304 comprises a second upper panel 306 that is generally rectangular and disposed generally parallel to the first upper panel 106, and extends laterally between a second left panel 308 and an opposite second right panel, and forward to a second front panel 312 and rearward to a second rear panel 314. The second left panel 308 and second right panel connect the second upper panel 306, second front panel 312, and second rear panel to the first upper panel 106. The second front panel 312 is generally rectangular and extends laterally between the second left panel 308 and second right panel, and upwardly and rearwardly from the first upper panel 106 to the second upper panel 306 forming a back rest surface.

The wedge assembly 352 includes a wedge body 354 having a bottom face 358 extending laterally between a left face 360 and an opposite right face, and rearward toward a rear face. The rear face extends upward generally perpendicular from the bottom face 358 between the left and right faces 360, 362 terminating at a top face. The front face 364 extends upward from the bottom face 358 at an acute angle to the bottom face 358 between the left face 360 and the right, and extends rearward toward the top face thereby defining a generally elongated wedge body 354. When viewed from either the left face 360 or the right face, the wedge assembly tapers from a relatively wide lower portion to a more narrow upper portion.

The upper chamber is accessed from within the top cover assembly 104 by an opening 322 secured by a cooperating removable connector or zipper 324. The zipper 324 is opened and the wedge assembly 352 is inserted into the upper chamber.

It will be appreciated that the components of the cover assemblies 102 and 302 can be used for various other applications. Moreover, the cover assemblies 102 and 302 can be fabricated in various sizes and from a wide range of suitable materials, using various manufacturing and fabrication techniques. In an embodiment, the cover assemblies 102 and 302 include more or less than six cots 252.

It is to be understood that while certain aspects of the disclosed subject matter have been shown and described, the disclosed subject matter is not limited thereto and encompasses various other embodiments and aspects.

The invention claimed is:

1. A cover assembly for storing an object with an upper surface and for providing a seating surface supported by the object, comprising:

a top cover assembly, comprising:
an upper panel; and
sidewalls depending therefrom;

a bottom cover assembly, comprising:
a lower panel; and
sidewalls extending upward therefrom;

a cushion assembly within the top cover assembly, comprising:
a deformable material adjacent the upper panel including a bottom surface depending therefrom;

wherein the top cover and bottom cover are joined at the sidewalls;

wherein the deformable material bottom surface is adapted to compliment the object upper surface, thereby supporting the seating surface; and wherein:
the upper panel and sidewalls of the top cover assembly defining a downwardly open rectangular enclosure forming four corners;
a plurality of upper corner supports, each upper corner support disposed within each top cover corner and being entirely within the downwardly open rectangular enclosure of the top cover assembly;
the lower panel and sidewalls of the bottom cover assembly defining an upwardly open rectangular enclosure forming four corners; and
a plurality of lower corner supports, each lower corner support disposed within each bottom cover corner and being entirely within the upwardly open rectangular enclosure of the bottom cover assembly.

2. The cover assembly of claim 1, wherein the deformable material includes an upper portion and a lower portion, wherein the upper portion has a peripheral edge that extends beyond the edges of the lower portion.

3. The cover assembly of claim 2, wherein:
the lower portion extends between a left end and a right end defining a width, a front end and a back end defining a depth, and a top end and a bottom end defining a thickness; and
wherein the left end is crescent shaped and the right end is crescent shaped.

4. The cover assembly of claim 3, wherein:
the left end crescent tapers outward from the bottom end to the top end; and
the right end crescent tapers outward from the bottom end to the top end.

5. The cover assembly of claim 4, wherein:
the left end crescent shaped taper extends from a broad middle portion to a narrow end portion at the front end and the back end; and
the right end crescent shaped taper extends from a broad middle portion to a narrow end portion at the front end and the back end.

6. The cover assembly of claim 1, wherein:
the cushion assembly is disposed between the top cover corner supports and the upper panel.

7. The cover assembly of claim 1, further comprising:
a back support portion forming an upper chamber at the top cover upper panel; and
a wedge assembly received within the upper chamber.

8. A cover assembly for storing an object with an upper surface including a positive relief and a negative relief and for providing a seating surface supported by the object, comprising:

a top cover assembly, comprising:
an upper panel;
sidewalls depending therefrom;
the upper panel and sidewalls of the top cover assembly defining a downwardly open rectangular enclosure with four upper interior corners;
a plurality of upper corner pockets, each at each upper interior corner; and a bottom cover assembly, comprising:
a lower panel;
sidewalls extending therefrom;
the lower panel and sidewalls of the bottom cover assembly defining an upwardly open rectangular enclosure with four bottom interior corners; and
a plurality of lower corner pockets, each lower corner pocket at each bottom interior corner;

a plurality of upper corner supports, each upper corner support disposed within each upper corner pocket and entirely within the downwardly open rectangular enclosure;

a plurality of lower corner supports, each lower corner support disposed within each bottom corner pocket and entirely within the upwardly open rectangular enclosure;

a cushion assembly within the top cover assembly, comprising:
a pad assembly adjacent the upper panel including a bottom surface depending therefrom;

wherein the cushion assembly is disposed between the top cover corner supports and the upper panel; and wherein the pad assembly bottom surface is adapted to compliment the object upper surface;

thereby, the seating surface is supported by the object.

9. The cover assembly of claim 8, wherein each of the upper and lower corner pockets comprises:

a corner cover extending laterally between adjacent sidewalls of the respective top or bottom cover assembly;

wherein each of the upper corner pockets include a lower cap at the lower point of the sidewall whereby each of the upper corner pockets define an upwardly open pocket for receiving one of the upper corner supports; and wherein each of the lower corner pockets include an upper cap at the upper point of the sidewall whereby each of the lower corner pockets define a downwardly open pocket for receiving one of the lower corner supports.

10. The cover assembly of claim 9, wherein:
the pad assembly further comprises:
an upper portion;
a lower portion; and
wherein the upper portion has a peripheral edge that extends beyond the edges of the lower portion.

11. The cover assembly of claim 10, wherein:
the pad assembly upper portion is formed to conform to the positive relief; and
the pad assembly lower portion is formed to conform to the negative relief.

12. The cover assembly of claim 11, wherein the pad assembly cover portion comprises:
a width extending between a crescent shaped left end and a crescent shaped right end;
a depth extending between a front end and a back end; and
a thickness extending between a front end and a back end.

13. The cover assembly of claim 12, wherein:
the left end crescent tapers outward from the bottom end to the top end; and
the right end crescent tapers outward from the bottom end to the top end.

14. The cover assembly of claim 13, wherein:
the left end crescent shaped taper extends from a broad middle portion to a narrow end portion at the front end and the back end; and
the right end crescent shaped taper extends from a broad middle portion to a narrow end portion at the fort end and the back end.

15. The cover assembly of claim 8, further comprising:
a back support portion forming an upper chamber at the top cover upper panel;
an opening in the top cover upper panel providing access to the upper chamber; and
a wedge assembly received within the upper chamber, the wedge assembly comprising:
a bottom face extending laterally between a left face and a right face, and rearward toward a rear face;
the rear face extending upward generally perpendicular from the bottom face between the left and right faces, terminating at a top face;
the top face extending forward from the rear face generally parallel to the bottom face between the left and right faces, terminating at a front face;
the front face extending upward from the bottom face at an acute angle to the bottom face, between the left face and the right face, upward to the top face; and
wherein, the body tapers from a wide lower portion to a narrow upper portion.

16. A cover assembly for storing an object with an upper surface including a positive relief and a negative relief and for providing a seating surface supported by the object, comprising:
a top cover assembly, comprising:
an upper panel;
sidewalls depending therefrom;
the upper panel and sidewalls of the top cover assembly defining a downwardly open rectangular enclosure with four upper interior corners; and
a plurality of upper corner pockets, each at each upper interior corner;
a bottom cover assembly, comprising:
a lower panel;
sidewalls extending therefrom;
the lower panel and sidewalls of the bottom cover assembly defining an upwardly open rectangular enclosure with four bottom interior corners; and
a plurality of lower corner pockets, each at each bottom interior corner;
a plurality of upper corner supports, each upper corner support disposed within each upper corner pocket and entirely within the downwardly open rectangular enclosure;
a plurality of lower corner supports, each lower corner support disposed within each bottom corner pocket and entirely within the upwardly open rectangular enclosure;
a cushion assembly within the top cover assembly, comprising:
a pad assembly adjacent the upper panel including a bottom surface depending therefrom;
wherein the cushion assembly is disposed between the top cover corner supports and the upper panel;
wherein the pad assembly bottom surface is adapted to compliment the object upper surface;
thereby, the seating surface is supported by the object;
a back support portion forming an upper chamber at the top cover upper panel; and
a wedge assembly received within the upper chamber, the wedge assembly comprising:
a bottom face extending laterally between a left face and a right face, and rearward toward a rear face;
the rear face extending upward generally perpendicular from the bottom face between the left and right faces, terminating at a top face;
the top face extending forward from the rear face generally parallel to the bottom face between the left and right faces, terminating at a front face;
the front face extending upward from the bottom face at an acute angle to the bottom face, between the left face and the right face, upward to the top face; and
wherein, the body tapers from a wide lower portion to a narrow upper portion.

17. The cover assembly of claim 16, wherein the pad assembly further comprises:
an upper portion;
a lower portion extending between a left end and a right end defining a width, a front end and a back end defining a depth, and a top end and a bottom end defining a thickness;
wherein the upper portion has a peripheral edge that extends beyond the edges of the lower portion; and
wherein the left end is crescent shaped and the right end is crescent shaped.

18. The cover assembly of claim 17, wherein:
the left end crescent shaped taper extends from a broad middle portion to a narrow end portion at the front end and the back end; and
the right end crescent shaped taper extends from a broad middle portion to a narrow end portion at the front end and the back end.

19. The cover assembly of claim 18, wherein:
the pad assembly upper portion is formed to conform to the positive relief; and
the pad assembly lower portion is formed to conform to the negative relief.

20. A cover assembly for storing an object with an upper surface and for providing a seating surface supported by the object, comprising:
a top cover assembly, comprising:
an upper panel;
sidewalls depending from the upper panel, comprising:
a first sidewall panel depending from the upper panel;
a second sidewall panel depending from the upper panel;
the upper panel and sidewalls of the top cover assembly defining a downwardly open rectangular enclosure with four upper interior corners;
a back support portion extending from the upper panel, the back support portion forming an upper chamber; and
a wedge assembly, wherein the wedge assembly tapers from a relatively wide lower portion to a narrow upper portion;
a bottom cover assembly, comprising:
a lower panel; and
sidewalls extending upward from the lower panel, comprising:

a first sidewall panel extending upward from the lower panel; and a second sidewall panel extending upward from the lower panel;

the lower panel and sidewalls of the bottom cover assembly defining a upwardly open rectangular enclosure with four bottom interior corners;

a plurality of upper corner supports, each upper corner support disposed within each upper interior corner and entirely within the downwardly open rectangular enclosure;

a plurality of lower corner supports, each lower corner support disposed within each bottom interior corner and entirely within the upwardly open rectangular enclosure;

a cushion assembly within the interior of the top cover assembly, comprising:

a deformable material adjacent the upper panel, the deformable material forming a bottom surface depending therefrom adapted to compliment the features of the object upper surface, thereby the seating surface is supported by the object; and wherein the upper panel second sidewall and lower panel second sidewall are joined by a cooperating removable connector.

21. The cover assembly of claim 20, wherein the deformable material comprises:

an upper portion forming a peripheral edge;

a lower portion extending between a left end and a right end defining a width, a front end and a back end defining a depth, and a top end and a bottom end defining a thickness;

wherein the upper portion peripheral edge extends beyond the lower portion left end and lower portion right end.

22. The cover assembly of claim 21, wherein the lower portion left end is crescent shaped, and the lower portion right end is crescent shaped.

23. The cover assembly of claim 22, wherein:

the left end crescent tapers outward from the bottom end to the top end; and the right end crescent tapers outward from the bottom end to the top end.

24. The cover assembly of claim 23, wherein:

the left end crescent shaped taper extends from a broad middle portion to a narrow end portion at the front end and the back end; and the right end crescent shaped taper extends from a broad middle portion to a narrow end portion at the front end and the back end.

25. The cover assembly of claim 20, wherein each upper interior corner comprises:

a corner cover extending laterally between adjacent sidewalls depending from the upper panel;

a lower cap at the lower point of the adjacent sidewalls depending from the upper panel and the lower point of the corner cover; and the corner cover, the lower panel, and the adjacent sidewalls depending from the upper panel define an upwardly open pocket for receiving a corner support.

* * * * *